United States Patent [19]

Schneider et al.

[11] Patent Number: 4,461,068

[45] Date of Patent: Jul. 24, 1984

[54] AUTOMATIC SLOTTING APPARATUS WITH TOOL CHANGING DEVICE

[75] Inventors: Franz Schneider, Göppingen; Ewald Bergmann, Rechberghausen; Otto Kurz, Hattenhofen; Hans-Martin Dommer, Göppingen, all of Fed. Rep. of Germany

[73] Assignee: L. Schuler GmbH, Fed. Rep. of Germany

[21] Appl. No.: 397,032

[22] Filed: Jul. 12, 1982

Related U.S. Application Data

[63] Continuation of Ser. No. 75,485, Sep. 14, 1979, abandoned.

[30] Foreign Application Priority Data

Sep. 14, 1978 [DE] Fed. Rep. of Germany ..... 2839992

[51] Int. Cl.[3] ..... B23Q 3/155

[52] U.S. Cl. ..... 29/568; 72/446; 83/549; 83/563

[58] Field of Search ..... 29/26 A, 33 P, 568; 72/446; 83/563, 549

[56] References Cited

U.S. PATENT DOCUMENTS

| | | | |
|---|---|---|---|
| 3,548,480 | 12/1970 | Daniels | 29/568 X |
| 3,571,873 | 3/1971 | Muller et al. | 29/33 P X |
| 3,678,562 | 7/1972 | Leibinger | 29/568 X |
| 3,772,954 | 11/1973 | De Ruwe et al. | 83/563 X |
| 3,816,904 | 6/1974 | Herb | 29/568 |
| 4,103,414 | 8/1978 | Herb et al. | 29/568 |
| 4,220,062 | 9/1980 | Blanz | 83/549 X |

FOREIGN PATENT DOCUMENTS 2365033 7/1975 Fed. Rep. of Germany .

*Primary Examiner*—Z. R. Bilinsky
*Attorney, Agent, or Firm*—Craig & Burns

[57] ABSTRACT

Automatic sliding apparatus is provided for automatically stamping stator and rotor laminations for electric motors from workpiece blanks. To accommodate utilization of a plurality of sets of tool dies on a single driveable press ram, a tool changing device is provided which includes a tool holder guide track for movably guiding the tool holder along a straight guide path in a plane at a tangent to the workpieces to be machined. With the plurality of tool die sets mounted at the linearly guided tool holder, tool exchanges can be effected simply and automatically, utilizing a linear drive mechanism for moving the respective tool die sets along the frame of the tool holder.

5 Claims, 4 Drawing Figures

AUTOMATIC SLOTTING APPARATUS WITH TOOL CHANGING DEVICE

This is a continuation of application Ser. No. 75,485 filed Sept. 14, 1979 now abandoned.

BACKGROUND AND SUMMARY OF THE INVENTION

The invention relates to an automatic numerically controlled tool changing device, particularly for slot stamping machines, wherein the upper and bottom tool dies are mounted in a tool holder while the lower dies which are not operatively engaged can be lowered below the plane of conveyance of the workpieces to be machined. By way of background information and to aid in a better understanding of the types of devices which this invention is directed at improving, reference is hereby made to commonly assigned copending U.S. patent application Ser. No. 961,246, filed Nov. 16, 1978 now U.S. Pat. No. 4,232,575, and Ser. No. 013,062, filed February 21, 1979. The contents of these related U.S. applications are incorporated herein by reference thereto. Reference is also made to brochures published by the assignee of this application, titled "Programmable CNC-Controlled Segment Notching Press" and "Manually Loaded and Automatic Notching Machines", for further background information.

In the case of stamping and slotting machines, numerically controlled tool changing devices are known (German Offenlegungsschrift No. 25 26 765), in which the top and lower dies which have to be brought into operative engagement are drawn from a round magazine, also referred to as a turrett, where such machines are concerned, it is normally necessary for as many tools as possible to be available for all manner of machining work. With such a tool changing device, it is furthermore known (German Offenlegungsschrift No. 25 26 764), for the tools which are not operatively engaged to be lowered below the conveying or machining plane or for the tool which is in operative engagement to be raised to the machining plane.

Starting from the premise of this state of the art, the invention is based on the problem of providing a numerically controlled tool changing device which is particularly suitable for slot stamping machines, wherein the need for multiple tool changing is of subordinate practical importance.

According to the invention, this problem is solved by providing an arrangement wherein the tool holder is guided by means of a straight guide and is movable in a plane which is tangent to the workpiece to be machined. This invention recognizes that under normal practical circumstances, with the type of slot stamping machines contemplated, scarcely more than four to six tools with one tool changing device are used. According to the invention the tool holder in which the sets of tools are mounted and pre-positioned is guided in a straight line so that engagement requires a positioning drive which need act only in a straight line. A significant advantage of the tool changing device according to the invention lies in the fact that by virtue of the straight line guidance, employing only one positioning drive, it is possible on the one hand for tools to be changed accurately and on the other to slot workpieces, i.e., plates, with a chamfer. The latter stamping process requires adjustment of the tool tangentially of the sheet bar to be machined which for every sheet represents a small step compared with a tool change.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE DRAWINGS

Figure 1:
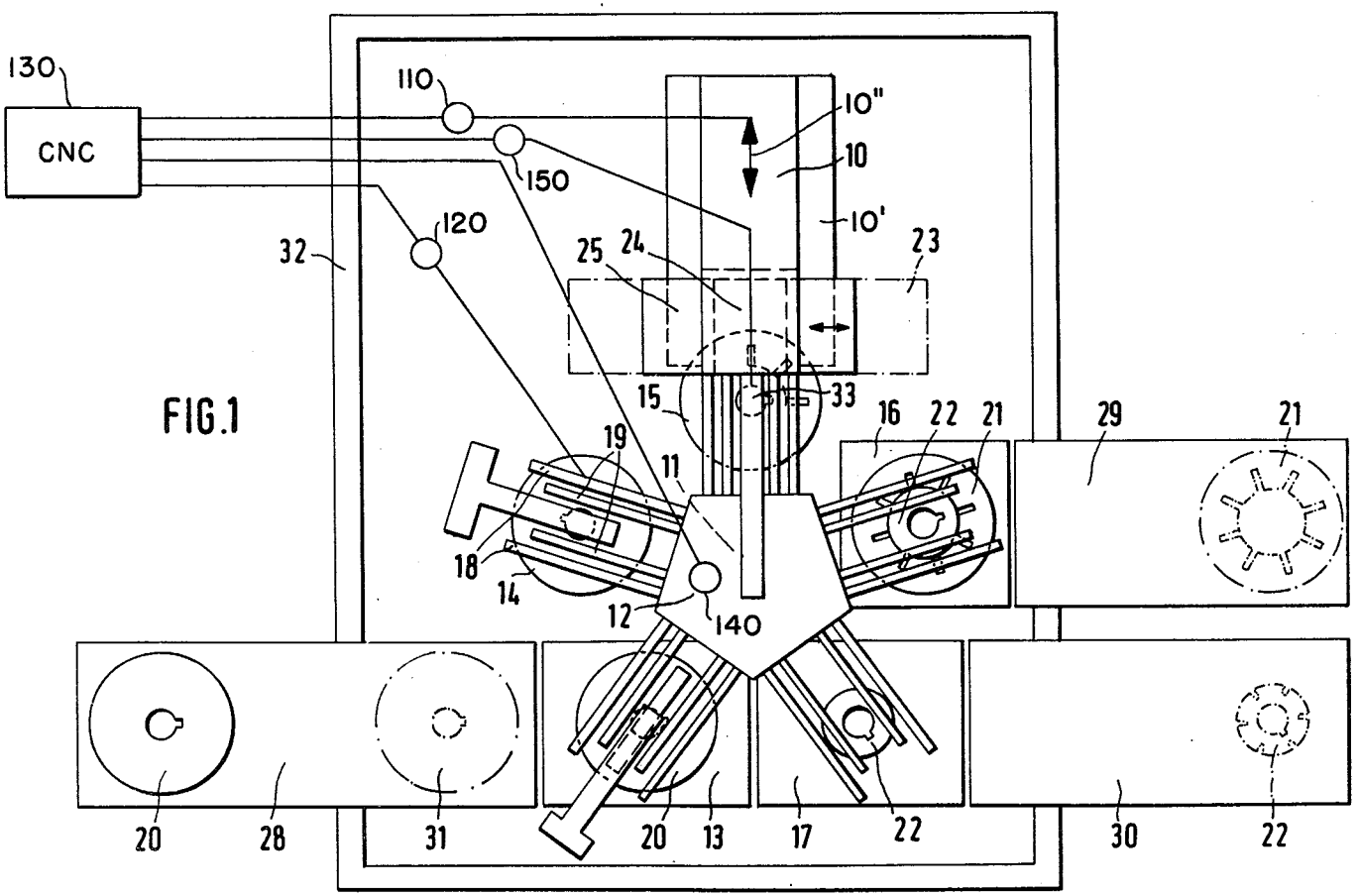
FIG. 1 is a schematic plan view of a slot stamping machine and tool changing device constructed in accordance with a preferred embodiment of the present invention.

Referring now to the drawings wherein like reference numerals are used in the various views to designate like parts, and more particularly, to FIG. 1, the notching or slotting press arrangement includes a notching or slotting machine 10, supported on a bench 10', and a five-armed feeding and removal device 11 constructed as an indexing spider for automatically feeding and removing blanks to and from the slotting machine 10. The slotting machine 10 is adjustable radially with respect to the blank being processed in a direction of movement designated by the reference numeral 10'' by means of a conventional adjustable drive 110 which is connected with a numerical control system 130.

The five-armed feeding and removal device 11 is constructed as an indexing spider and is adapted to automatically feed, remove, and transport blanks to various processing stations. For this purpose, the five-armed feeding and removing device 11 includes capstan or turntable 12 which is adapted to transfer blanks between a stack unloading station 13, a centering, locating, and/or turning station 14, a processing station 15, a stator stacking station 16, and a rotor stacking station 17.

To accommodate various diameters of stator laminations and rotor laminations, the feed and discharge device 11 is provided with magnetic conveying rails 18, 19 which are switchable or adjustable by suitable control means so that both un-notched blanks 20 and stator laminations 21 as well as rotor laminations 22 can be transported. The magnetic conveying rails 18 are adapted to be set for predetermined diameters of the stator laminations 21 and the conveying rails 19 are adapted to be set for predetermined diameters of the rotor laminations 22. For this purpose, a central actuating drive 120 is provided which is connected with the numerical control system 130.

Figure 3:
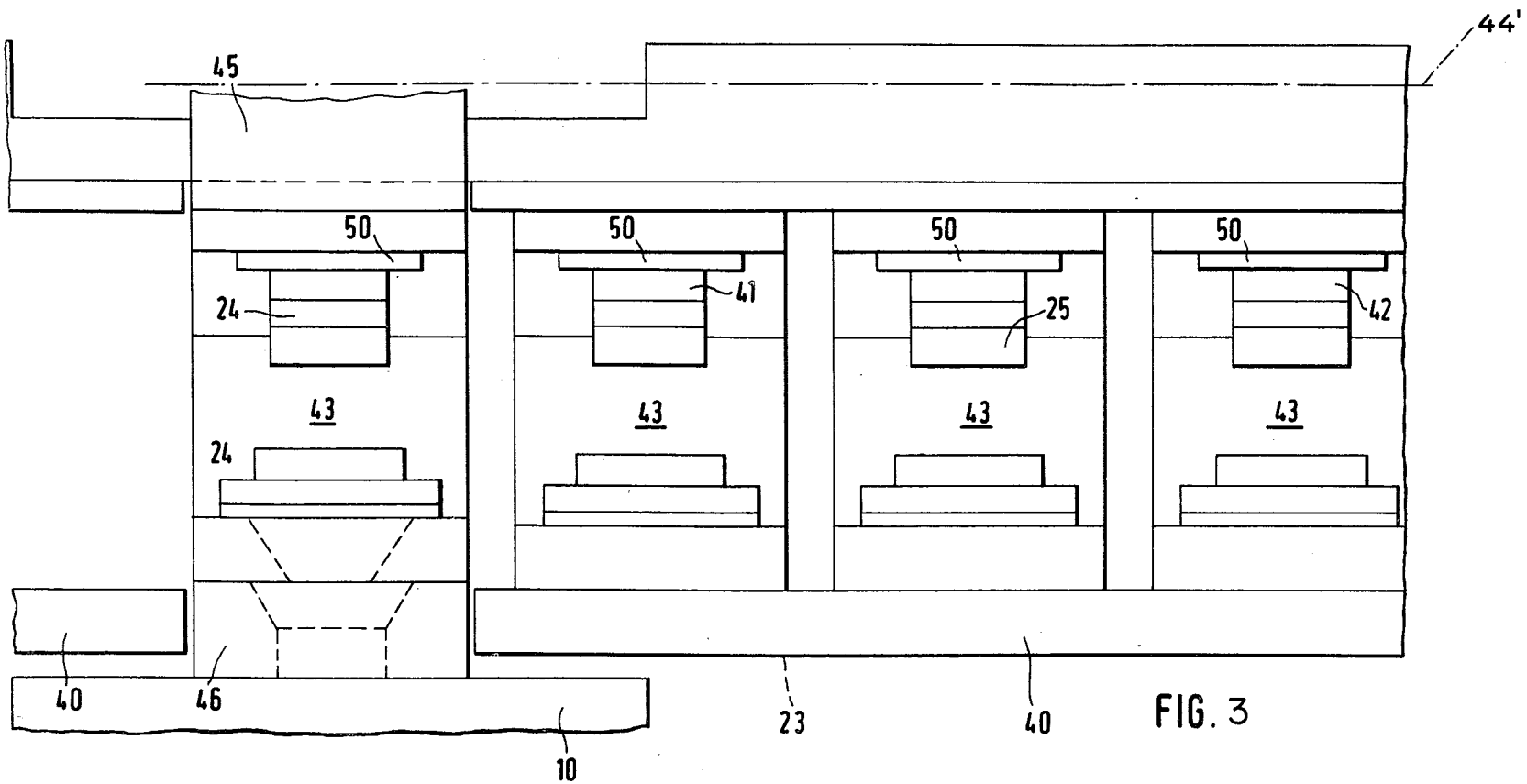
FIG. 3 is a front schematic enlarged view of a tool changing device constructed in accordance with the present invention.
Figure 4:
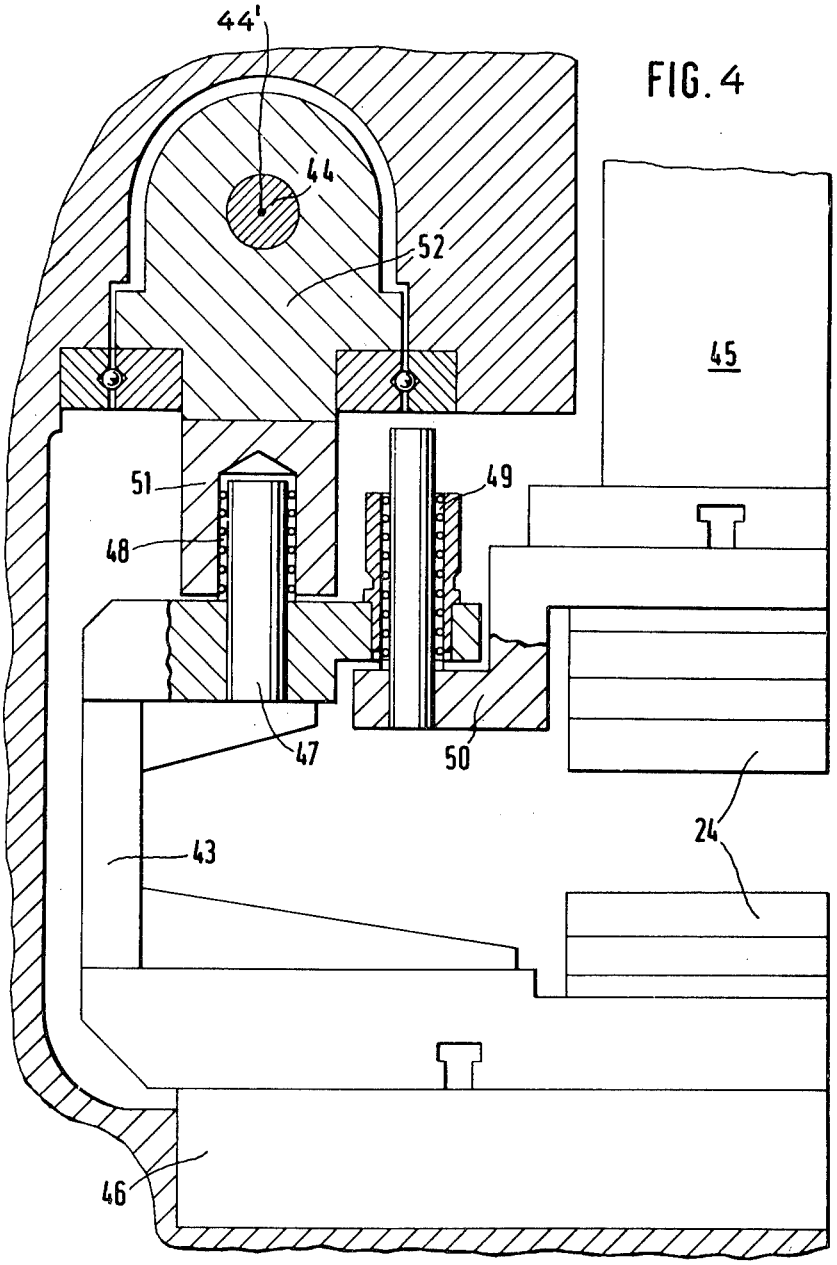
FIG. 4 is a side schematic, part-sectional view of the tool changing device of FIG. 3.

Furthermore, the slotting machine 10 is equipped with a numerically controlled tool changing device 23 shown only schematically in FIG. 1 along with a stator slotting and separating tool 24 and a rotor slotting tool 25. In FIGS. 3 and 4, the tool changing device 23 is more comprehensively illustrated and contains stator slotting, rotor slotting and ventilation slot cutting tools, as described in more detail below.

Figure 2:
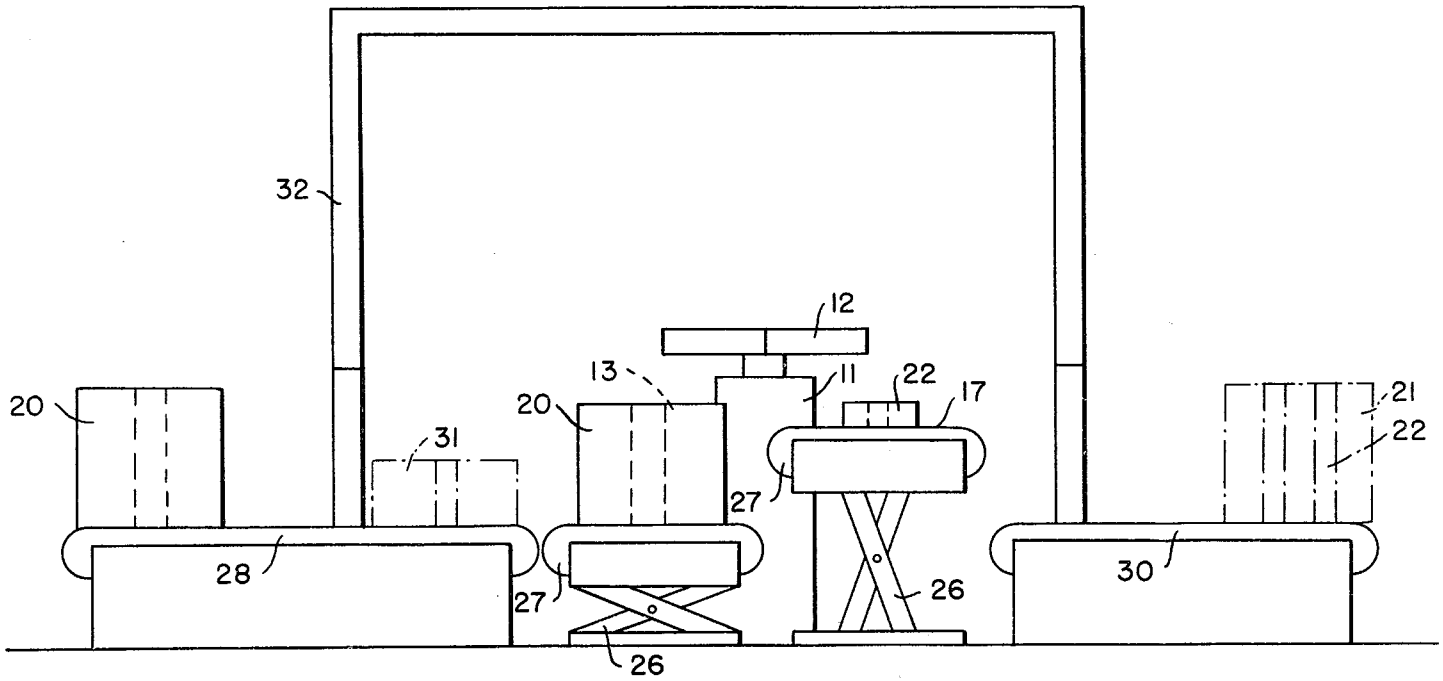
FIG. 2 is a partially schematic frontal view of the arrangement of FIG. 1.

As shown in FIG. 2, the stack unloading station 13 and the rotor stacking station 17 each include an elevating truck or platform 26. Each of the elevating trucks or platforms 26 includes conveying devices in the form of, for example, horizontal conveyors which are adapted to be driven by suitable drive means (not shown) independently of the turntable or turnstile 12. The elevating platforms 26 and horizontal conveyors 27 form a link between the rotor stacking station 17 and the stack unloading station 13 in a manner more fully described hereinbelow.

The stator stacking station 16 is also provided with a horizontal conveyor 27 in a manner not shown in the drawings. Stationary conveyors 28, 29 and 30 are provided for linearly horizontally conveying the blanks and/or laminations. The conveyors 28, 29, 30 are arranged in direct connection with the stack unloading station 13, the stator stacking station 16 (FIG. 1) and the rotor stacking station 17 for the purposes of fully automating the production process.

After processing of the blanks, finished bundles of stator laminations 21 and rotor laminations 22 are transferred by means of the conveyors 29, 30 from the horizontal conveyors 27 of the elevating platforms 26 of the rotor stacking station 17 and stator stacking station 16 whereby the bundles of laminations 21, 22 are available for removal for subsequent bundling, welding, or other processing. The conveyor 28 for the stack unloading 13 is preferably constructed in such a manner that it provides for an intermediate storage station 31 the function of which will be explained more fully hereinafter.

To provide for effective noise attenuation, the automatic slotting or notching press arrangement is surrounded by a soundproofing cabin 32 or enclosure with the feeding and removing of the un-notched blanks and finished stator laminations 21 and rotor laminations 22 being carried out through noise locks such as described in, for example, Offenlegungsschrift 23 65 033. The entire automatic notching press arrangement described hereinabove is wholly controlled by the numerical control system 130 which is preferably a CNC control system.

The automatic tool changing device 23 of the present invention is illustrated in FIGS. 3 and 4 and has a tool holder 51 which is equipped with a stator slotting and separating tool 24, a first ventilation slot cutting tool 41, a rotor slotting tool 25 and a second ventilation slot cutting tool 42, all of which are mounted in the C-shaped carrier elements 43.

The tool holder 51 is guided by means of a straight guide 52 which is propelled in a linear direction via a close-fitting ball-bearing spindle 44, which is preferably driven by a numerically controlled positioning drive controlled by the CNC 130. The guide 52 is supported at the frame of tool changing device 23 by bearings 52' so as to move (relative to the frame) only in the direction of axis 44' (schematically shown in FIGS. 3 and 4) of spindle 44 in a plane (schematically indicated by arrows 44'' in FIG. 1) tangent to the workpiece to be machined; namely the plate 20, a stator plate 21 and/or rotor plate 22. The propulsion process serves first and foremost for automatic tool changing but is however applicable to a sensitive adjustment as will be explained hereinafter.

In order to be able to lower the tools 41, 25, 42 which are not in operative engagement with a tool ram 45 and a press table 46 of the slot stamping machine 10 (in the operative position shown in FIGS. 2 and 3), the C-shaped carrier elements 43 are provided with locating pins 47 which are closely mounted in associated pre-tensioned roller bearing guides 48 in the tool holder 51. The C-shaped carrier elements 43 are also provided with a ball-bearing guide 49 in which mounting plates 50 for the upper dies are guided so as to be vertically movable. The mounting plates 50 for the upper dies and the correspondingly mounted lower dies are automatically clamped in operative engagement on the tool ram 45 and on the press table 46 by conventional clamping mechanisms, not shown (see, for example, U.S. Pat. No. 3,111,895). The upper and lower dies 24, 41, 25, 42, when out of operative engagement, are maintained in the opened position (See FIG. 3).

The operation of the slotting or notching press arrangement during one working cycle is as follows:

The conveyor 28 transports or conveys un-notched blanks 20 to the elevating platform 26 of the stack unloading station 13. The blanks 20 in the stack unloading station 13 are unstacked in a conventional manner by the magnetic conveying rails 18, 19 and fed, by an indexing of the feeding and removing device 11 driven by conventional means 140, to the centering, locating and/or turning station 14. At the station 14, the blanks 20 undergo a dual blank check and blank thickness measurement as well as a centering, locating and/or turning so as to properly position the blanks 20 for further processing in the processing station 15. The blank thickness measurement is used to determine the height of the bundles for stator laminations 21 and rotor laminations 22.

From the station 14, the blanks 20 are conveyed by a further indexing of the feeding and removing device 11 into the processing station 15 where a stationary indexing unit 33 accepts the blank 20. In the illustrated embodiment, the indexing unit 33 is driven by a numerically controlled actuating drive 150; however, it is also possible to drive the indexing unit by the slotting or notching press 10 by way of a conventional mechanical linkage (not shown) with the indexing of the indexing unit 33 being very possibly by a numerically controlled change of gears.

In the processing station 15, the slotting or notching press 10 is operated whereby the stator laminations 21 are notched and separated from the rotor laminations 22 by the stator notching and separating tool 24. The feeding and removing device 11 is once again indexed so that the notched stator laminations 21 and un-notched rotor laminations are conveyed jointly out of the processing station 15 by means of the magnetic conveying rails 18 and 19 with the finished stator laminations 21 being stacked on the elevating platform 26 of the stator stacking station 16 while the un-notched rotor laminations 22 are stacked on the elevating platform 26 of the rotor stacking station 17.

As soon as a bundle of stator laminations is completed, the automatic notching or slotting press arrangement is stopped and any un-notched blanks 20 still lying in the stack unloading station 13 are conveyed by the conveyor 27 of the platform 26 of the unloading station 13 to the intermediate storage station 31 with the finished notched stator laminations then being removed from the stator stacking station 16 by means of the horizontal conveyor 27 of the stator stacking station 16 and the conveyor 29. The unnotched rotor laminations 22 are then conveyed by way of the horizontal conveyor 27 of the stack unloading station 13. The tool changing device 23 shown in FIGS. 3 and 4 and described above, is operated and the stator notching and separating tool 24 is exchanged or replaced by a rotor notching tool 25. The conveying of the un-notched rotors 22 to the unloading station 13 and the changing of the tool by the tool changing device 23 as well as, for example, the conveying of the un-notched blanks 20 to the storage station 31 and conveyance of the finished notched stator laminations 21 can be effected simultaneously by virtue of the control of the numerical control system 130.

The un-notched rotor laminations 22 in the stack unloading station 13 are then unstacked thereat and transferred by the feeding and removing device 11 to the stations 14, 15 and 17 whereby the un-notched rotor lamination 22 is aligned or located, subsequently notched, and finally stacked up in the rotor stacking station 17. After a bundle of rotor laminations 22 is completed, the bundle is removed by means of the conveyor 30 in the same manner as the stator laminations 21 and rotor laminations 22 for electric machines can be obtained and can be immediately further processed in a bundling and/or welding station. While the description hereinabove indicates two passes for the blanks 20 (21, 22 through the arrangement it is also contemplated to have three or more passes to, for example, produce ventilation slots using tools 41 and 42 of FIG. 4.

The tool change itself is brought about via the ball-bearing spindle 44 which brings the particular tool required 24, 41, 25, 42 (see FIGS. 3 and 4) into operative engagement via the tool holder 51 which is movable in one plane. For tool changing, the C-shaped carrier elements 43 are lifted to the level of the press table 46 via a vertically movable tool table 40. When the tool change has been completed, the tools which are in operative engagement are automatically clamped on the press ram 45 and on the press table 46, while the tools which are disengaged are lowered by the tool table 40 so that they are below the machining plane. This process requires vertical clearance freedom, which is achieved by the pre-tensioned roller bearing guides 48.

The tool holder 51 is fitted with the C-shaped carrier elements 43 which carry the tools, outside of the slot stamping machine 10. Thus, in order to produce one specific type of motor, the respective tool holder 51 with the premounted tools 24, 41, 25, 42 only has to be brought into engagement with the straight guide 52 by means of per se known quick-action coupling devices.

In contrast to the example of working cycle described in detail above according to FIG. 1, which has only two tools 24, 25, which then also requires only two passages, the tool changing device 23 according to FIGS. 3 and 4 is provided with four tools 24, 41. 25, 42 and correspondingly requires four passages before the stator and rotor plates 21, 22 are completed.

By mounting the tool holder 51 by means of a straight guide 52, a tangential displacement in respect of the blanks 20 which are to be stamped out is also possible in very fine steps from blank 20 to blank 20. The necessary accuracy results inter alia from the choice of a suitable positioning drive. As a result of this construction according to the invention, it is possible by means of the tool changing device 23 to produce packages with obliquely slotted and/or rotor laminations 21, 22. Such plate or lamination packages are characterized in that viewed over the length of the package, a twisted slot can be provided with a straight winding conductor.

It is also possible for the blank 20 to be clamped onto the indexing unit 33 only once for processing, that is, in order to produce bundles of finished stator laminations 21 and rotor laminations 22. For this purpose, the tool changing device 23 would have to be operated a number of times for each blank instead of once per bundle.

It is also possible to construct the rotor stacking station 17 as a stack unloading station. In this manner, it would not be necessary to convey the un-notched rotor laminations 22 but the stator stacking station must also be capable of accepting notched rotor laminations 22.

As shown in FIG. 2, the elevating trucks or platforms 26 are selectively displaceable by conventional means (not shown) between a lower position in alignment with the conveyors 28, 30 to an upper position. By virtue of the displaceability of the platforms 26, the unloading at the stack unloading station 13 as well as the loading at the rotor and stator stacking stations 17, 16 is facilitated. More particularly, by controlling the displacement means by the numerical control system 130, the elevating platform 26 at the stack unloading station 13 can be progressively raised as the blanks 20 are removed from the stack of blanks and conveyed to the other processing stations. Likewise, the platforms 26 at the rotor and stator lamination stacking stations 17, 16 can be progressively lowered as the finished laminations are transferred to the respective stations. As is apparent, during a transfer of the un-notched stator laminations from the rotor stacking station 17 to the stack unloading station 13, the platforms 26 of the respective stations 17, 13 are brought into alignment.

The automatic slotting or notching press arrangement according to the present invention makes it possible to produce finished bundles of stator laminations 21 and rotor laminations 22 automatically by means of one notching press 10 while avoiding the use of intermediate storage stations. Moreover, special motors such as motors with conical armatures can also be produced automatically with the notching or slotting press arrangement of the present invention and the associated CNC control system.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Automatic numerically controlled slotting machine apparatus having a tool changing device which has a plurality of respective upper and lower tool dies mounted in a tool holder, comprising means for selectively moving non-operative ones of said lower tool dies to positions below the plane of conveyance of circular workpieces being processed by the slotting machine, an indexing unit that can be rotated in steps carrying each circular workpiece during processing, and tool holder guide means for movably guiding the tool holder along a straight guide path in a plane and tangential to the circle of rotation around said indexing unit, whereby tool changes can be effected by moving said tool holder along said straight guide path, said slotting machine includes a processing station with a movable press ram that acts on said tool dies during processing of a workpiece, and said tool changing device is operable to selectively position the tool die sets in the processing station to be acted on by the press ram wherein the tool holder is fitted with C-shaped carrier means for holding respective ones of the tools while the tools and carrier elements are at least one of inside and outside the processing station and during tool change.

2. Apparatus according to claim 1 wherein the C-shaped carrier means are mounted in the tool holder by means of locating pins and pre-tensioned roller-bearing guides.

3. Apparatus according to claims 1 or 2, wherein the C-shaped carrier means are each provided with a ball-bearing guide in which an upper die carrying mounting plate is guided for movement in the direction of the working stroke.

4. Apparatus according to claims 2 or 3, wherein the tool holder is propelled by means of a clearance-free ball-bearing spindle.

5. Automatic numerically controlled slotting machine apparatus having a tool changing device which has a plurality of respective upper and lower tool dies mounted in a tool holder; comprising means for selectively moving non-operative ones of said lower tool dies to positions below the plane of conveyance of circular workpieces being processed by the slotting machine, an indexing unit that can be rotated in steps carrying each circular workpiece during processing, and tool holder guide means for movably guiding the tool holder along a straight guide path in a plane and tangential to the circle of rotation around said indexing unit to effect tool changes by moving said tool holder along said straight guide path, said slotting machine includes a processing station with a movable press ram that acts on said tool dies during processing of a workpiece, and said tool changing device is operable to selectively position the tool die sets in the processing station to be acted on by the press ram, and the tool holder is fitted with C-shaped carrier means for always holding respective ones of the tools while the tools and carrier elements are inside and outside the processing station and during tool change.

* * * * *